US008387195B2

(12) United States Patent
Patel

(10) Patent No.: US 8,387,195 B2
(45) Date of Patent: Mar. 5, 2013

(54) EDUCATIONAL TOOTHBRUSH

(75) Inventor: Anish Patel, Fontana, CA (US)

(73) Assignee: Ashtel Studios Inc., Fontana, CA (US)

( * ) Notice: Subject to any disclaimer, the term of this patent is extended or adjusted under 35 U.S.C. 154(b) by 272 days.

(21) Appl. No.: 12/914,757

(22) Filed: Oct. 28, 2010

(65) Prior Publication Data

US 2011/0035888 A1 Feb. 17, 2011

(51) Int. Cl.
*A46B 15/00* (2006.01)

(52) U.S. Cl. ..... 15/105; 15/167.1; 15/176.1

(58) Field of Classification Search ..... 15/105, 15/167.1, 176.1
See application file for complete search history.

(56) References Cited

U.S. PATENT DOCUMENTS

| | | | | |
|---|---|---|---|---|
| 4,866,807 | A | 9/1989 | Kreit et al. | |
| 5,044,037 | A | 9/1991 | Brown | |
| 5,259,086 | A | 11/1993 | Fong | |
| 5,339,479 | A | 8/1994 | Lyman | |
| 5,438,726 | A | 8/1995 | Leite | |
| 5,894,453 | A | 4/1999 | Pond | |
| 6,029,303 | A | 2/2000 | Dewan | |
| 6,076,223 | A * | 6/2000 | Dair et al. | 15/167.1 |
| 6,106,294 | A | 8/2000 | Daniel | |
| 6,154,912 | A | 12/2000 | Li | |
| 6,202,242 | B1 * | 3/2001 | Salmon et al. | 15/22.1 |
| 6,202,245 | B1 | 3/2001 | Khodadadi | |
| 6,954,961 | B2 | 10/2005 | Ferber et al. | |
| D511,044 | S | 11/2005 | Berde | |
| 8,046,864 | B2 * | 11/2011 | Baertschi et al. | 15/167.1 |
| 8,201,295 | B2 * | 6/2012 | Gatzemeyer et al. | 15/22.1 |
| 2005/0278882 | A1 | 12/2005 | Drzewiecki et al. | |
| 2006/0037158 | A1 * | 2/2006 | Foley et al. | 15/105 |
| 2007/0131241 | A1 | 6/2007 | Nanda | |
| 2007/0190509 | A1 | 8/2007 | Kim | |
| 2008/0028553 | A1 * | 2/2008 | Batthauer | 15/105 |

* cited by examiner

*Primary Examiner* — Lee D Wilson
*Assistant Examiner* — Shantese McDonald
(74) *Attorney, Agent, or Firm* — LeonardPatel PC

(57) ABSTRACT

Some embodiments of the present invention describe an educational toothbrush that includes a brush head with bristles, a brush neck, and a body. The body includes a top portion and a bottom portion. The top portion of the body and the bottom portion of the body are configured to operably connect to each other to form the body. The body also includes a button configured to activate the educational toothbrush and deactivate the educational toothbrush.

10 Claims, 7 Drawing Sheets

EDUCATIONAL TOOTHBRUSH

FIELD

The present invention is related to an educational toothbrush and, in particular, to an educational toothbrush to guide children on proper tooth brushing techniques.

BACKGROUND

A toothbrush is an oral hygiene instrument that is critical for cleaning teeth and gums. However, many children and adults do not employ proper tooth brushing habits as recommended by the American Dental Association. For example, many children not only fail to brush their teeth for the recommended time period of two minutes, but also fail to brush all of their teeth. For instance, some children may only brush their back teeth, while other children may only brush their front teeth.

Also, while some children presume they are brushing their teeth for two minutes, they are mostly standing around with the toothbrush in their mouths. For example, some children use a two-minute timer when brushing their teeth. However, while the child brushes his or her teeth, the child on occasion walks around or stands in front of the mirror with the toothbrush in his or her mouth. When the timer expires, the child then proceeds to rinse out his or her mouth and wash the toothbrush. In this instance, the child has not brushed his or her teeth for the time period recommended by the American Dental Association.

SUMMARY

Certain embodiments of the present invention may provide solutions to the problems and needs in the art that have not yet been fully identified, appreciated, or solved by current toothbrushes. For example, certain embodiments of the present invention provide an educational toothbrush that correctly and effectively engages and guides the child in proper tooth brushing techniques based on a character affixed to the educational toothbrush. This is one example of features that currently available toothbrushes do not provide.

In accordance with an embodiment of the present invention, an educational toothbrush is provided. The educational toothbrush includes a brush head with bristles, a brush neck, and a body. The body includes a top portion and a bottom portion. The top portion and the bottom portion of the body are configured to operably connect to each other to form the body. The body also includes a button configured to activate the educational toothbrush and deactivate the educational toothbrush.

BRIEF DESCRIPTION OF THE DRAWINGS

For proper understanding of the present invention, reference should be made to the accompanying figures. These figures depict only some embodiments of the invention and are not limiting of the scope of the invention. Regarding the figures.

DETAILED DESCRIPTION OF THE EMBODIMENTS

It should be readily understood that the components of the present invention, as generally described and illustrated in the figures herein, may be arranged and designed in a wide variety of different configurations. Thus, the following detailed description of the embodiments, as represented in the attached figures, is not intended to limit the scope of the invention as claimed, but is merely representative of selected embodiments of the invention.

Indeed, the features, structures, and/or characteristics of the invention described throughout this specification may be combined in any suitable manner in one or more embodiments. The usage of "certain embodiments," "some embodiments," or similar language, throughout this specification refers to the fact that a particular feature, structure, or characteristic described in connection with the embodiment may be included in at least one embodiment of the present invention. Thus, appearances of the phrases "in certain embodiments," "in some embodiments," "in other embodiments," or other similar language, throughout this specification do not necessarily all refer to the same embodiment or group of embodiments, and the described features, structures, or characteristics may be combined in any suitable manner in one or more embodiments.

One or more embodiments of the present invention provide an educational toothbrush configured to effectively engage and guide a child through proper tooth brushing techniques and/or habits. In certain embodiments, the toothbrush may be configured to play music and/or instructions to the child based on a character (i.e., a dog, cat, cow, monkey, etc.) affixed to the toothbrush. However, the type of character or shape is not limited to animal shapes and could be any shape, fictional character or cartoon character that a child may find appealing.

Figure 1:
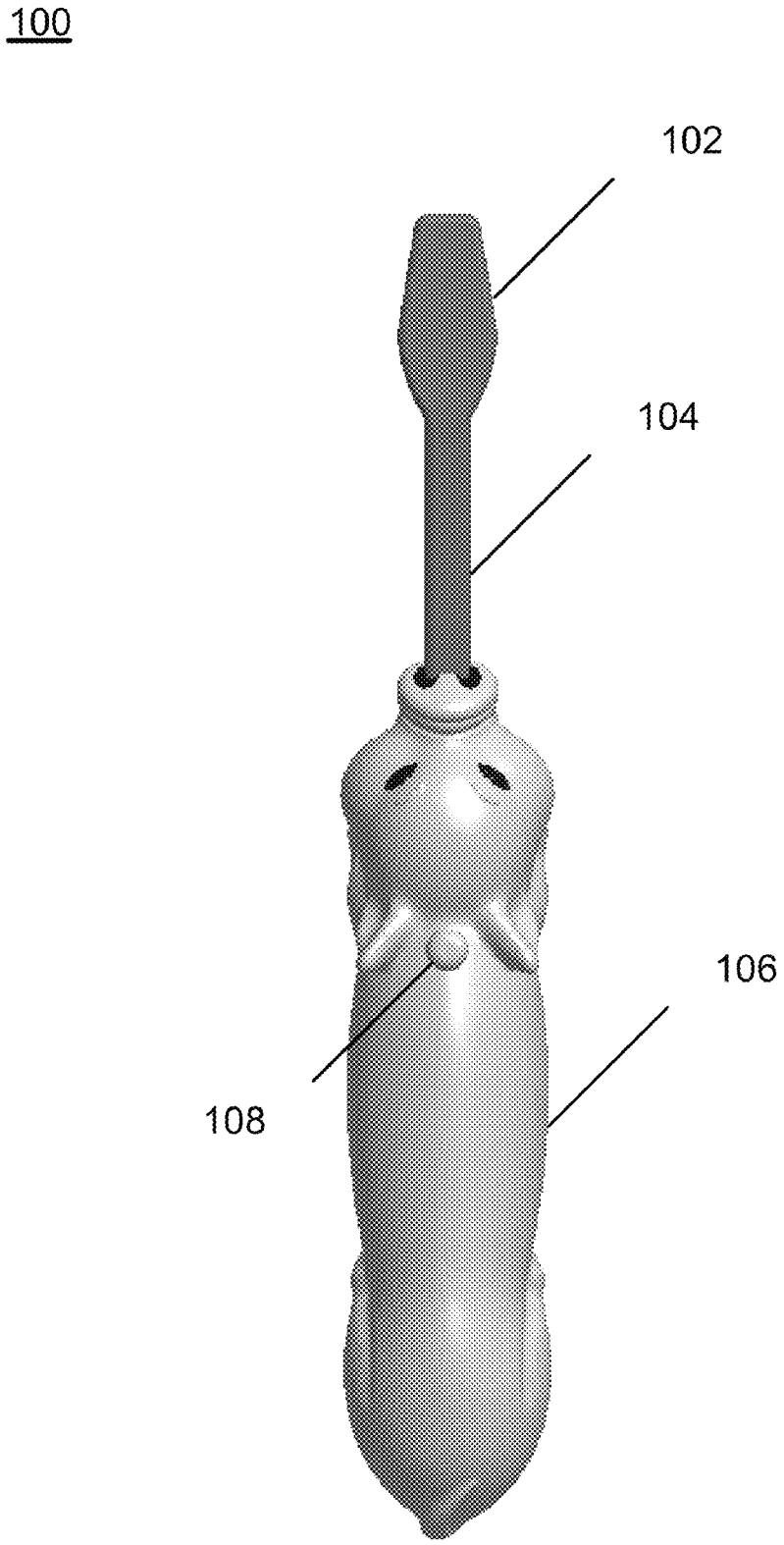
FIG. 1 is a top view of an educational toothbrush in accordance with one or more embodiments of the present invention.

FIG. 1 is a top-view of an educational toothbrush 100 in accordance with an embodiment of the present invention. Educational toothbrush 100 includes a brush head 102, a brush neck 104, a body 106, and a button 108.

In this embodiment, body 106 can be of any form, such as a dog, cat, cow, pig, monkey, dinosaur, etc. Body 106 can include a top or first portion and a bottom or second portion, which is described in further detail below. The top and bottom portions of body 106 are constructed, for example, to attach to brush neck 104. The top portion of body 106 includes, but is not limited to, a circuit, an audio device, and a battery (see FIG. 5 for more detail).

Button 108 may be configured to activate and deactivate educational toothbrush 100. For example, when the child presses button 108, educational toothbrush 100 begins to guide or instruct the child through proper brushing techniques for a time period of two (2) minutes. More or less time may be used as desired. However, per the above, two minutes is recommended by the American Dental Association. If however, during the two-minute time period, the child presses button 108, then educational toothbrush 100 will deactivate and stop communicating instructions to the child. When the child presses button 108 again, educational toothbrush 100 will start communicating the instructions from the beginning in order to properly guide the child through proper tooth brushing techniques for the two-minute time period. Once the two-minute time period elapses, educational toothbrush 100 may be configured to automatically deactivate. Such a feature can prevent a child from using improper tooth brushing habits and also encourage the child to brush all areas of his/her teeth for two minutes.

Figure 2:
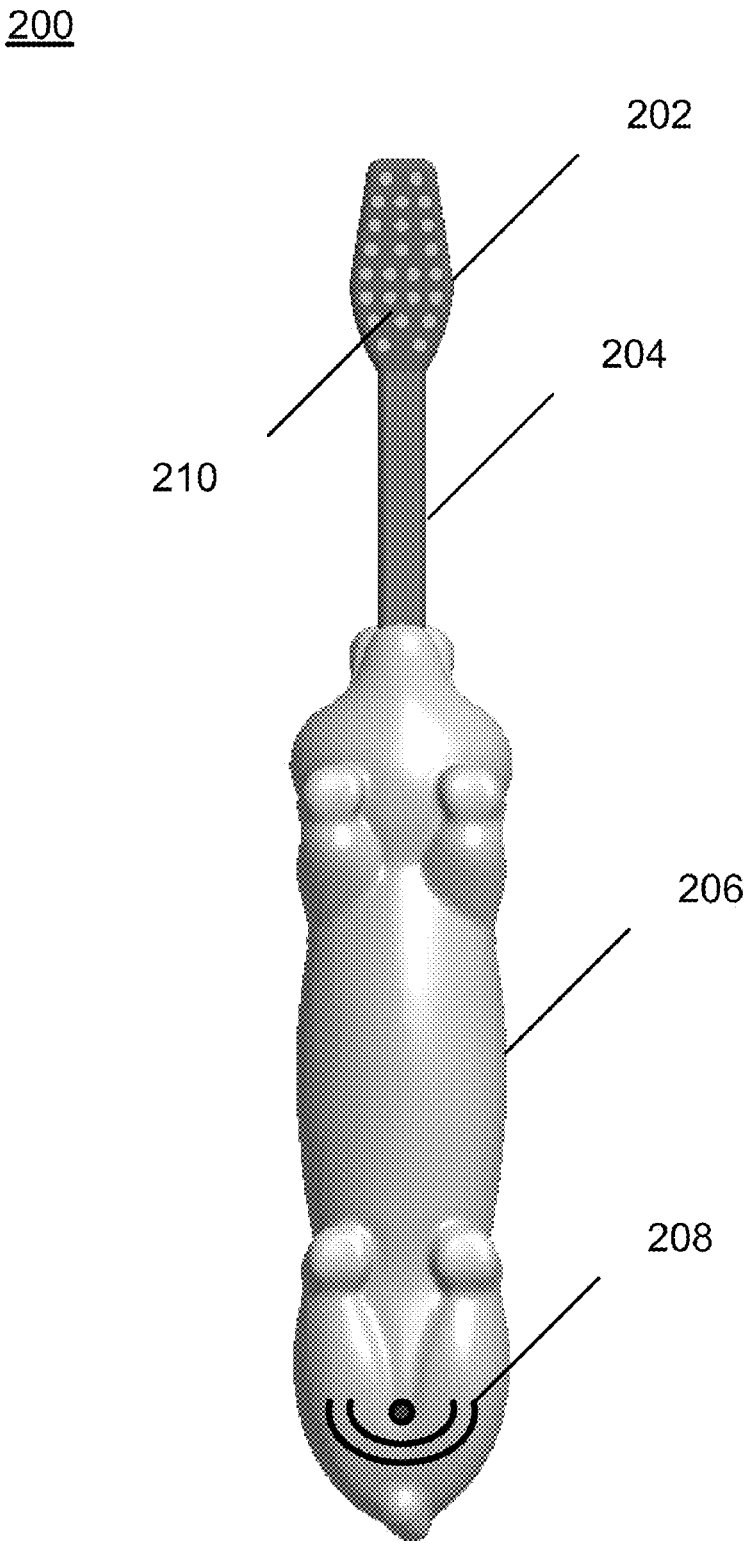
FIG. 2 illustrates a bottom view of an educational toothbrush in accordance with one or more embodiments of the present invention.

FIG. 2 illustrates a bottom view of an educational toothbrush 200 in accordance with another embodiment of the present invention. Educational toothbrush 200 includes a brush head 202, a brush neck 204, a body 206, and an audio output section 208. Brush head 202 includes bristles 210 to brush the teeth.

Audio output section 208 is configured to allow the educational instructions and/or music to be heard from an audio device that is situated in body 206. In this embodiment, audio output section 208 is designed to have three slots in body 206. The first slot is circular, while the second and third slot of audio output section 208 is a semicircle. It should be appreciated, however, that audio output section 208 can include more or less than three slots in body 206. It should also be appreciated that the slots are not limited to a circular pattern or a semicircle pattern, but can be any type of pattern that would be appreciated by a person of ordinary skill in the art.

Figure 3:
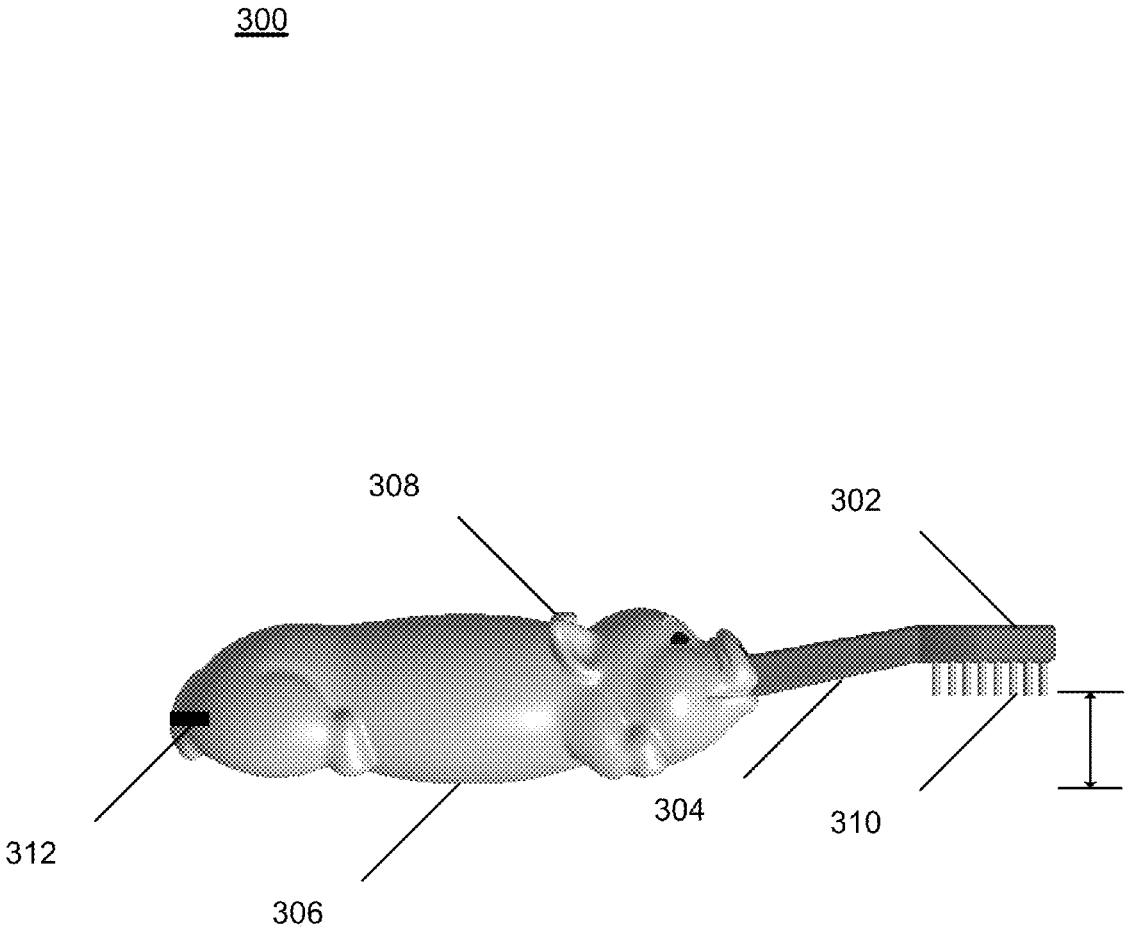
FIG. 3 illustrates a side view of an educational toothbrush in accordance with one or more embodiments of the present invention.

FIG. 3 illustrates a side view of an educational toothbrush 300 in accordance with another embodiment of the present invention. Educational toothbrush 300 includes a brush head 302, a brush neck 304, a body 306, a button 308, bristles 310, and a liquid outlet 312.

When, for example, a child is washing educational toothbrush 300, water, toothpaste or any other type of fluid may enter body 306 via the audio output section described above. As a result, water, toothpaste or any other type of fluid may be confined or constricted inside body 306, and may cause the instructions and/or music outputted from the audio device to be suppressed. To prevent the instructions and/or music from being suppressed, liquid outlet 312 is configured to allow water, toothpaste or any other type of fluid to exit from body 306.

In addition, when, for example, a toothbrush is placed on its bottom side, the bristles of the toothbrush can touch a surface of a counter in a bathroom. In order to prevent bristles 310 from touching the surface of the counter, brush neck 304 extends from body 306 in an upward direction such that bristles 310 and brush head 302 are elevated above the surface of the counter. Such a configuration prevents bacteria on the surface of the counter from directly contacting bristles 310 when educational toothbrush 300 is placed on its bottom side.

Figure 4:
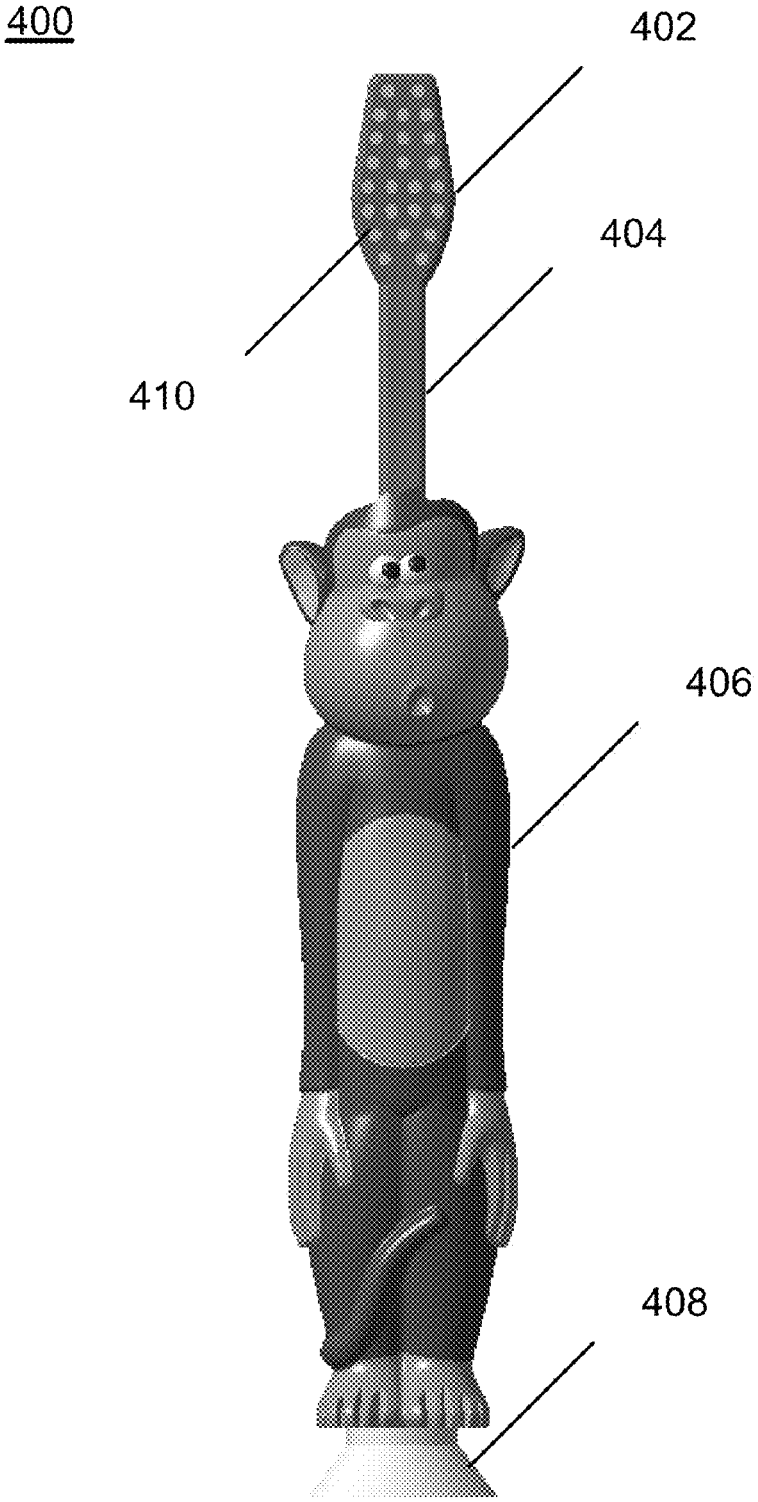
FIG. 4 illustrates a front view of an educational toothbrush in accordance with other embodiments of the invention.

FIG. 4 illustrates a front view of an educational toothbrush 400 in accordance with another embodiment of the invention. Educational toothbrush 400 includes a brush head 402, a brush neck 404, a body 406, a stand 408, and bristles 410. In this embodiment, to prevent bristles 410 from touching the counter in the bathroom, educational toothbrush 400 includes stand 408. Stand 408 may be a solid base or may be comprised of material that can act as a suction cup. Stand 408 allows educational toothbrush 400 to be placed vertically, thereby preventing a horizontal placement of educational toothbrush 400, as well as preventing bristles 410 from directly contacting the surface of the bathroom countertop.

Figure 5:
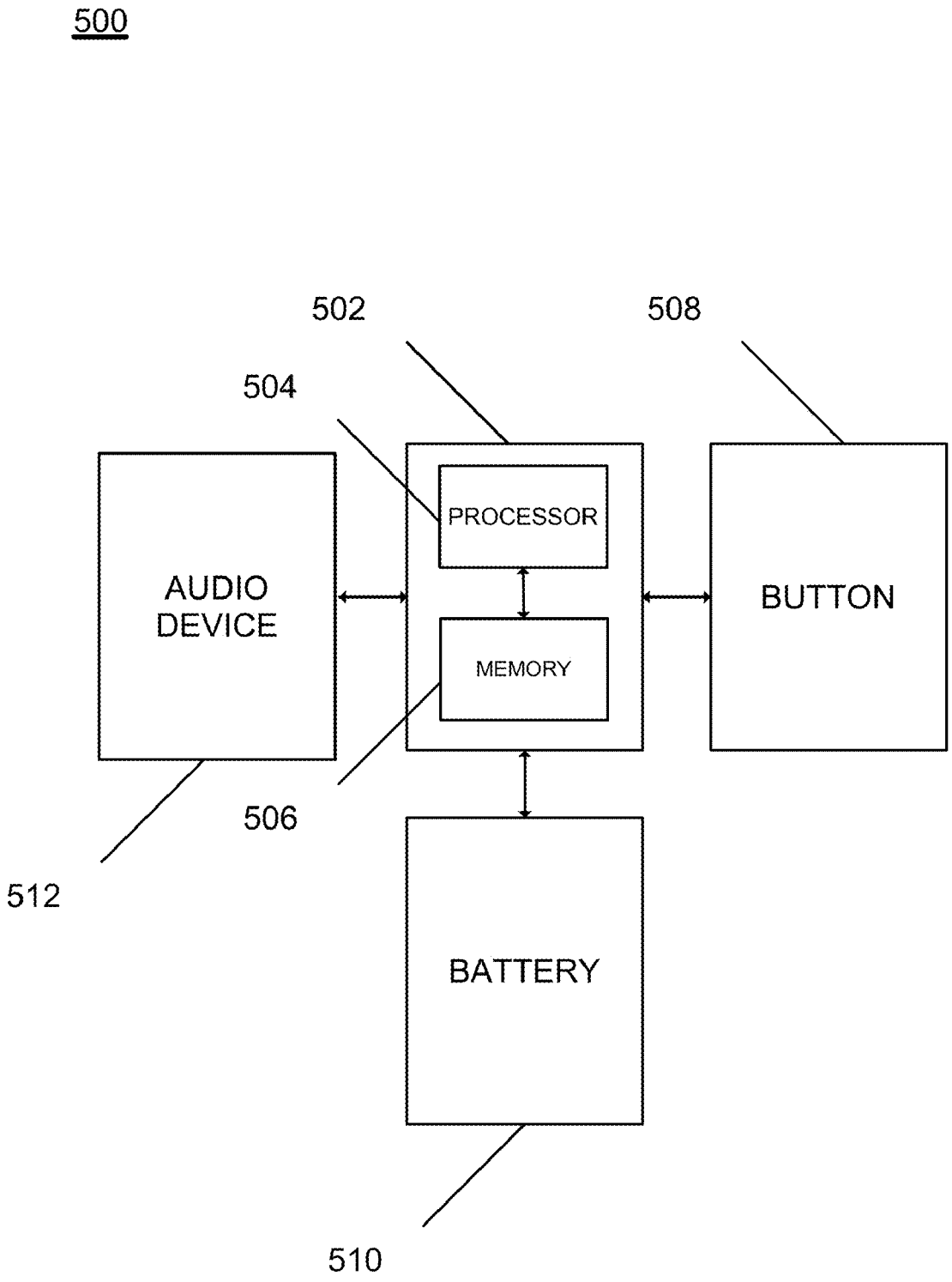
FIG. 5 is a block diagram of an educational toothbrush in accordance with one or more embodiments of the present invention.

FIG. 5 illustrates a circuit diagram 500 of an educational toothbrush in accordance with an embodiment of the present invention. Circuit diagram 500 includes, but is not limited to, a circuit 502, a processor 504, memory 506, a button 508, a battery 510, and an audio device 512. Circuit 502 is operably connected to button 508, battery 510, and audio device 512. Circuit 502 includes processor 504 and memory 506, which are operably connected to each other.

Processor 504 may be a general-purpose or specific-purpose processor or microcontroller. Memory 506 may include one or more internally fixed storage units, removable storage units, and/or remotely accessible storage units. Also, memory 506 may include any suitable combination of volatile memory and/or non-volatile memory and can be configured to store information, data, instructions, and/or software code.

Memory 506 is configured to store data corresponding to one or more tooth brushing instructions and/or music. For instance, if the body of the educational toothbrush is a cow, then data facilitating the following script can be stored in memory 506: "It's time to brush! Start with those bottom teeth. Move your toothbrush round, move your toothbrush up and down. You got it! Perfect! Don't stop! Keep moving that brush! Move to the top teeth. Move your toothbrush round and round. Move your toothbrush up and down. Keep it up you're mooing towards healthy teeth. Cowabunga! You did it!" This script can be configured to be played in intervals such as 5 seconds, 10 seconds, 12 seconds, or any combination thereof. However, any interval or combination of intervals may be used. It should be appreciated that data facilitating the play of music can be stored in memory 506.

In an alternative embodiment, if the body of the educational toothbrush is a pig, then data facilitating the following script can be stored in memory 506: "Alright, teeth you've met your match. It's time to get super clean. Ready, let's brush! Start with those top teeth. Alright, you're doing great. Now brush those bottom teeth. Way to go. Keep going. Oink. Oink. Remember . . . if you like to eat like I do; ice cream . . . candies . . . and cookies oh my! It's super important to brush at least twice a day, oink-oink-oink, to keep that super bug away, oink-oink-oink. Alright, see you later!" This script can be configured to be played in intervals such as 5 seconds, 10 seconds, 15 seconds, or any combination thereof. However, any interval or combination of intervals may be used. It should be appreciated that data facilitating the play of music can be stored in memory 506.

In another embodiment, if the body of the educational toothbrush is a monkey, then data facilitating the following script can be stored in memory 506: "Stop monkeying around, and keep the sugar bug away. On you mark . . . get set . . . go! Start with those top teeth. Now brush your right side. Brush little circles on the inside. Brush little circles on the outside. Now stay up top and go to the left side. Brush little circles on the inside. Brush little circles on the outside. Keep going! You are doing a great job! Now let's go to those bottom teeth. Start by brushing your left side. Brush little circles on the inside. Brush little circle on the outside. All right! Now stay on the bottom and brush the right side. Brush little circles on the inside. Brush little circles on the outside. Alright, you got it! Now say cheese as big as you can. Start brushing all around in circles. All done. Great Job! You finished! You beat the sugar bug, he is gone for now. See you soon." It should be appreciated that this script can be configured to be played in intervals of 5 seconds, or any other interval. It should be appreciated that music can be stored in memory 506.

In another embodiment, if the body of the educational toothbrush is a cat, then data facilitating the following script can be stored in memory 506: "It's time to brush your teeth right, meow. Start by brushing those top teeth. Brush on the right side. Brush on the left side. Perfect, keep it up! Now, let's meow onto the bottom teeth. Brush on the right side. Brush on the left side. Meow, now don't forget to rinse. Perfect, you got it! See you next time!" It should be appreciated that this script can be configured to be played in intervals of 15 seconds, or any other interval. It should be appreciated that data facilitating music can be stored in memory 506.

A person of ordinary skill in the art will appreciate that the music, song and/or script stored in memory 506 is based on the body (e.g. animal character) of the educational toothbrush. It should also be appreciated that the stored music and/or instructions can be played for a time period of two minutes.

Button 508 activates the educational toothbrush. For example, when the child presses button 508, processor 504 is activated and configured to retrieve the stored music and/or instructions from memory 506 and play the music and/or instructions through audio device 512 for a time period of two minutes. Processor 504 can also be configured to be deactivated and stop playing the music and/or instructions when the child presses button 508 before the two-minute time period is completed. When button 508 is pressed again, processor 504 is activated and configured to play the music and/or instructions from the beginning This configuration ensures that the child continuously brushes his/her teeth for 2 minutes.

Battery 510 can be, for example, a lithium ion battery, a nickel-cadmium battery, a disposable AA or AAA battery, or any type of battery that would be appreciated by a person of ordinary skill in the art. Battery 150 may be either rechargeable or disposable and may or may not be replaceable by a user. Battery 510 may have a shelf life of two years and a constant usage life of three months in some embodiments. Battery 510 is configured to provide power to circuit 502.

Figure 6:
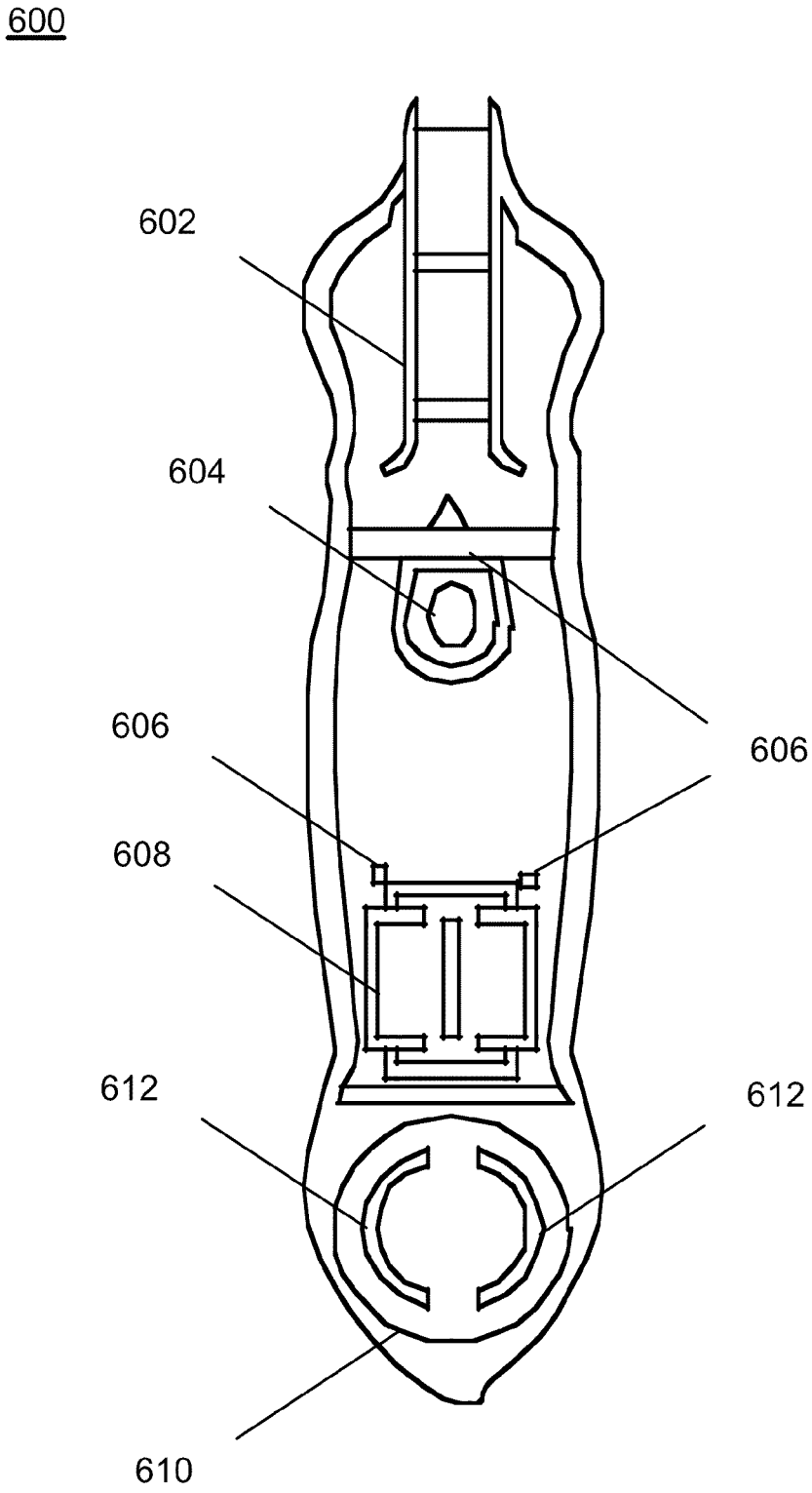
FIG. 6 illustrates an inside view of a top portion of the body of educational toothbrush in accordance with one or more embodiments of the present invention.

FIG. 6 illustrates an inside view of a top portion 600 of the body of educational toothbrush in accordance with one or more embodiments of the present invention. In this embodiment, top portion 600 can include brush neck slot 602, an opening or hole 604, circuit mounts 606, a battery holder 608, an audio device holder 610, and an elevated mount 612.

Brush neck slot 602 is configured to hold or secure a brush neck in place. In other words, when top portion 600 and bottom portion (not shown) are operably connected to each other, the brush neck will be secured between top portion 600 and the bottom portion (not shown in FIG. 6) to form the body of the educational toothbrush. Opening 604 is constructed to allow a button to be inserted through opening 604. As a result, when the child presses the button, the button activates a processor of the circuit to carry out the function of communicating proper tooth brushing techniques to the child.

Circuit mounts 606 are configured to hold a circuit such as that described in FIG. 5 in place when top portion 600 and the bottom portion are operably connected to each other to form the body of the educational toothbrush. Battery holder 608 is configured to securely hold a battery. Audio device holder 610 is configured to hold the audio device in place. Elevated mounts 612 are designed to prevent the audio device from being in contact with the inner wall of top portion 600. This allows music and/or instructions to be effectively communicated to the child due to the gap between the inner wall of top portion 600 and the audio device. This configuration also prevents audio from being suppressed when the child places his/her hands around the educational toothbrush in such a manner as to cover the audio device. In other words, the gap created by elevated mounts 612 allows the child to clearly hear the music and/or instructions.

Figure 7:
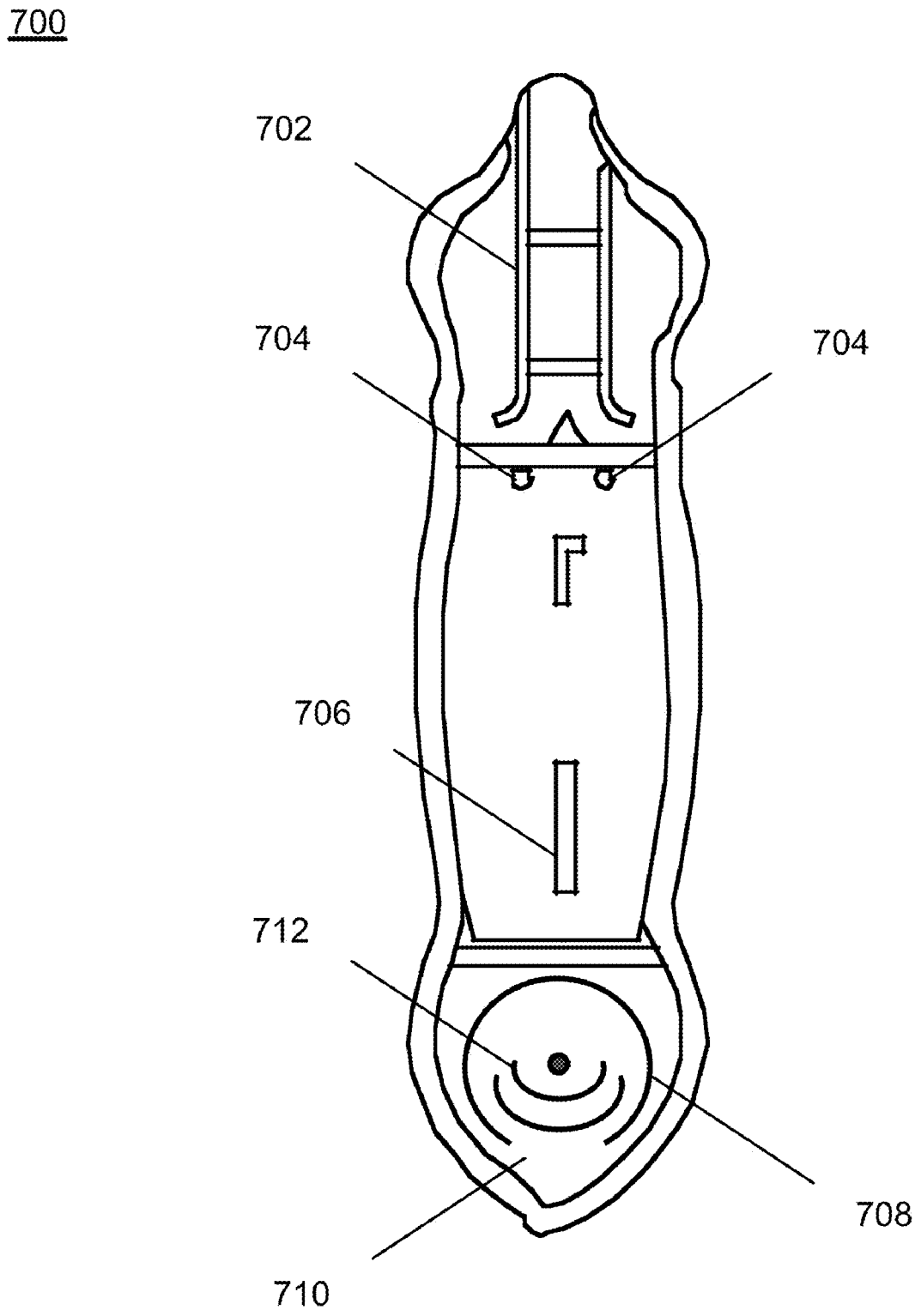
FIG. 7 illustrates an inside view of a bottom portion of educational toothbrush in accordance with one or more embodiments of the present invention.

FIG. 7 illustrates an inside view of a bottom portion 700 of educational toothbrush in accordance with one or more embodiments of the present invention. In this embodiment, bottom portion 700 includes a brush neck slot 702, circuit mounts 704, battery mount 706, audio device holder 708 with opening 710, and audio output sections 712.

Brush neck slot 702 is configured to hold or secure a brush neck in place. In other words, when bottom portion 700 and the top portion (not shown) are operably connected to each other, the brush neck will be secured between bottom portion 700 and the top portion of the body of the educational toothbrush.

Circuit mounts 704 are provided to secure the circuit such that the circuit is prevented from shifting and/or moving inside the body when the top portion and bottom portion 700 of the body are operably connected. Battery mount 706 is provided to secure the battery in place when the battery is inserted in the battery holder.

Audio device holder 708 is configured to hold and/or secure the audio device. Audio output sections 712 are configured to allow music and/or instructions outputted from the audio device to be effectively communicated to the child. In addition, to allow music and/or instructions to be effectively communicated through audio output sections 712, a spacer (not shown) may be provided between the inner wall of bottom portion 700 and the audio device. The spacer may be situated near the audio output sections 712. Opening 710 is configured to allow water, toothpaste, or any other fluid to exit out of the inner part of the body. For example, when the child washes or brushes his/her teeth, water and/or toothpaste may enter the audio device holder 708 and/or the inner part of the body from the audio output sections 712. To prevent water and/or toothpaste from being confined in audio device holder 708 and/or inner part of the body, opening 710 allows water and/or toothpaste to exit from audio device holder 708 and/or the inner part of the body. This configuration can prevent water, toothpaste, or any type of fluid from building up in the body or causing disturbance to the audio device.

It should be appreciated that the invention as discussed above may be practiced with hardware elements in configurations that are different than those specifically disclosed. As such, although the present invention has been described based upon the foregoing embodiments, modifications, variations, and alternative constructions may be made, while still remaining within the scope of the present invention. In order to determine the metes and bounds of the invention, therefore, reference should be made to the appended claims.

The invention claimed is:

1. An educational toothbrush, comprising:

a brush head with bristles;

a brush neck; and a body comprising a top portion and a bottom portion, wherein the top portion of the body and the bottom portion of the body are configured to operably connect to each other to form the body, the bottom portion of the body comprises an audio device holder comprising an opening configured to allow liquid entering the body from an audio output section to exit from the body of the educational toothbrush, and the body includes a button configured to activate the educational toothbrush and deactivate the educational toothbrush.

2. The educational toothbrush according to claim 1, wherein the brush neck extends upward from the body to prevent the bristles from contacting a surface.

3. The educational toothbrush according to claim 1, further comprising:

a stand operably connected to the body and configured to orient the educational toothbrush in a vertical direction in order to prevent the bristles from contacting a surface, wherein the stand is a solid base or a suction cup.

4. The educational toothbrush according to claim 1, wherein the body includes an outlet configured to allow water or toothpaste to exit the body.

5. The educational toothbrush according to claim 1, wherein the top portion of the body comprises:

a brush neck slot configured to hold the brush neck;

a circuit operably connected to the button, a battery, and an audio device; and a battery holder configured to hold the battery, wherein the audio device holder is configured to hold the audio device.

6. The educational toothbrush according to claim 5, wherein the audio device holder comprises an elevated mount configured to provide space between the audio device and an inner wall of the top portion of the body.

7. The educational toothbrush according to claim 5, wherein the circuit comprises a processor and a memory.

8. The educational toothbrush according to claim 7, wherein the memory is configured to store music and/or instructions based on a character formed by the body.

9. The educational toothbrush according to claim 7, wherein the processor is configured to play the music and/or instructions for a two-minute time period when the button is pressed, and is further configured to stop the music and/or instructions when the button is pressed before the two minute period is complete.

10. The educational toothbrush according to claim 1, wherein the bottom portion of the body comprises:

a brush neck slot configured to hold the brush neck;

circuit mounts configured to mount a circuit; and a battery mount configured to mount a battery, wherein the audio output section is configured to allow music and/or instructions to be outputted from an audio device when the button is pressed, and the audio device holder is configured to hold the audio device.

* * * * *